United States Patent [19]

Steele et al.

[11] Patent Number: 5,016,054

[45] **Date of Patent: * May 14, 1991**

[54] APPARATUS FOR IMPROVING A MULTI-COLOR ELECTROPHOTOGRAPHIC IMAGE

[75] Inventors: Lawrence C. Steele, Webster; Kenneth E. Rook, Rochester, both of N.Y.

[73] Assignee: Eastman Kodak Company, Rochester, N.Y.

[ * ] Notice: The portion of the term of this patent subsequent to Mar. 5, 2008 has been disclaimed.

[21] Appl. No.: 358,916

[22] Filed: May 26, 1989

[51] Int. Cl.[5] ..... G03G 15/10; G03G 15/01

[52] U.S. Cl. ..... 355/256; 355/202; 355/326

[58] Field of Search ..... 355/256, 302, 326–327, 355/301–304; 430/45, 57, 119

[56] References Cited

U.S. PATENT DOCUMENTS

| | | | |
|---|---|---|---|
| 2,751,616 | 7/1953 | Turner, Jr. et al. | 355/302 X |
| 3,900,003 | 8/1975 | Sato et al. | 118/645 |
| 3,970,383 | 7/1976 | Honda et al. | 355/327 |
| 4,101,320 | 7/1978 | Sellers et al. | 430/40 |
| 4,131,360 | 12/1978 | O'Brien | 355/319 |
| 4,157,219 | 6/1979 | Ohta et al. | 355/256 |
| 4,181,423 | 1/1980 | Pressman et al. | 355/327 |
| 4,247,191 | 1/1981 | Grace et al. | 355/327 |
| 4,449,475 | 5/1984 | Schinke | 118/645 |
| 4,639,124 | 1/1987 | Nye, Jr. et al. | 355/297 |
| 4,640,605 | 2/1987 | Ariyama et al. | 355/327 |
| 4,660,503 | 4/1987 | Jones | 118/645 |
| 4,734,788 | 3/1988 | Emmett et al. | 358/300 |

*Primary Examiner*—Joan H. Pendegrass
*Attorney, Agent, or Firm*—Robert L. Randall

[57] ABSTRACT

An improvement in apparatus for producing a multi-color electrophotographic image wherein an electrophotographic medium is mounted on a carrier therefor and is translated over a predetermined path so that the medium is first charged, then exposed to a first light-borne image. The image bearing region of the medium is then toned, preferably by a liquid toner, to produce a first color visible image. The carrier is then returned to the first position to repeat the foregoing steps to charge the medium and to expose it to a second light-borne image and to tone the second image with a second toning element to produce a second color visible image on the same sheet of medium. The improvement comprises means for buffing the surface of the first toned image with a relatively coarse, stiff, and rough fibrous brush member after the first toning step and prior to the second charging step to smooth the previously toned image to prevent color contamination by subsequent imaging cycles.

14 Claims, 3 Drawing Sheets

APPARATUS FOR IMPROVING A MULTI-COLOR ELECTROPHOTOGRAPHIC IMAGE

RELATED APPLICATIONS

The present invention relates to means for improving an electrophotographic image and is related to the improvements disclosed and claimed in copending applications Ser. No. 358,918, Method of Improving a Multicolor Electrophotographic Image in the names of Lawrence C. Steele and Kenneth E. Rook, and Ser. No. 358,101, Method of Improving a Multi-color Electrophotographic Image by Buffing an Image Toned with an Improved Toner, in the names of Lawrence C. Steele, Kenneth E. Rook, Domenic Santilli, and Dennis R. Kamp now U.S. Pat. No. 4,913,992, all filed on even date herewith.

BACKGROUND OF THE INVENTION

This invention relates to electrophoretic liquid development and more particularly to an improved process of plural stage development.

In the liquid development of electrostatic charge latent images, as in electrophotography and in other processes that form and develop electrostatic charge patterns, a substrate having a charge pattern on its surface is contacted with a liquid developer which is essentially a suspension of colloidal toner particles in an insulating liquid. Liquid developers normally contain also a stabilizer or charge control agent. The latter is an ionic compound which controls the magnitude of the charge on the toner particles and aids in maintaining a stable charge on the toner particles within the insulating carrier liquid.

Liquid developers can be used in single stage or plural stage development processes. Examples of the latter may include the sequential development on a photoconductor of two or more color-separation images, the annotation of a previously developed image, or the repeated re-exposure and development of images on a reusable photoconductor, with transfer of images upon completion of a number of imaging cycles.

In certain plural stage development processes which use liquid developers a problem has been found which is especially significant in processes for the electrophotographic reproduction of multi-color images of graphic arts quality. In these processes electrostatic latent images are formed sequentially on a chargeable substrate such as an electrophotographic medium, with liquid development or toning of each latent image before the next is formed. A leading example of this kind of system involves processing an electrophotographic medium sequentially through a series of four imaging cycles including four sequential development or toning stages.

While the present invention is useful in any electrostatic imaging process wherein a charge pattern is formed and developed with a liquid developer on a surface which has previously been developed with a liquid developer, it is particularly useful in combination with a recently developed electrophotographic process of making lithographic color proofs, such as described in U.S. Pat. No. 4,600,669. In that process a photoconductor, which has a uniformly charged thin transparent dielectric overlayer, is subjected to a series of exposures through registered color separation transparencies. After each exposure the dielectric layer is developed with a liquid developer, and the surface is again uniformly charged and exposed. The sequence is repeated for each of the color transparencies, usually four. It has been found that image defects occur in areas of the image which are toned areas of a previous imaging cycle. The defect appears as a color contamination of the previously toned areas which imparts a non-uniform density, thereby altering color rendition, a defect which, though perhaps acceptable in some kinds of add-on, plural stage imaging, is not acceptable for producing high quality images as required, for example, in the graphic arts field.

It has been discovered that the described image defects in plural-stage liquid development appear to be caused by the presence of forces, substances, or charge acceptance in the previously toned areas that interfere with the correct subsequent development in those areas. Although the nature of those forces or substances is not clear, the present invention provides apparatus that reduces or eliminates the problem.

U.S. Pat. No. 4,660,503 describes the improvement in the process of the '669 patent of cleaning the image by brushing the surface of the toned image with a soft, smooth, and supple fibrous brush member between the development of an image and the exposure of the next image to remove counterion material from the untoned areas which interferes with subsequent toning cycles in the above-mentioned process. The improvement of the '503 patent affects only the untoned areas of the developed substrate or photoconductor and has been found to have no effect on the toned areas where the present problem has been discovered.

Thus the problem addressed by the present invention is that of preventing color contamination of previously toned areas rather than preventing contamination of the untoned areas. The solution must not adversely affect the desired electrophoretic deposition of toner particles in both previously toned and untoned areas to develop the latent electrostatic image areas of subsequent imaging cycles.

Accordingly, the provision of a simple and relatively easily implemented solution to this problem, particularly if it can be done at a nominal cost and does not have any significant negative effects on the resulting image, would be very advantageous.

SUMMARY OF THE INVENTION

The present invention thus provides an apparatus for producing a multi-color electrophotographic image that enhances the image quality by preventing the small toner particles of liquid developers from adhering to previously toned areas unless electrostatic latent image fields are present to support such deposition.

According to one aspect of the present invention, apparatus for producing a multi-color electrophotographic image is provided which comprises means for providing an electrophotographic medium on a carrier therefor at a first position, means for translating the carrier and medium together over a predetermined path, means for charging the medium at a second position, and means for exposing the medium to a first light-borne image at a third position. Means is provided for toning the image to produce a first color visible image. Means is provided for returning the carrier and medium to the first position to repeat the foregoing steps to charge the medium and to expose it to a second light-borne image and to tone the second image with a second toning element to produce a second color visible image. The improvement of the present invention comprises means for buffing the image with a brush formed of a relatively coarse, stiff, and rough fibrous material, for example Nomex and Orlon fibers, following the first toning step and prior to the second charging step.

According to another aspect of the present invention, the brush member is formed as a rotating element which extends transversely to the direction of movement of the carrier during the brushing step.

According to yet another aspect of the present invention, the buffing brush smoothes the previously toned image to prevent color contamination of subsequent imaging cycles.

According to a further aspect of the present invention, apparatus for producing a multi-color electrophotographic image is provided which comprises a carrier arranged for translation over a predetermined path. Means is provided for mounting an electrophotographic medium on the carrier at a first position. Means is provided for translating the carrier and medium together over the path and for charging the medium at a second position. Means is provided for exposing the medium to a first light-borne image at a third position. Means is provided for developing the image to produce a first color visible image. Means is provided for returning the carrier and the medium to the first position to repeat the foregoing steps to charge the medium and to expose it to a second light-borne image and to tone the second image with a second toning element to produce a second color visible image. Means is provided for cleaning the surface of the image following development and prior to the second charging. The improvement comprises means for buffing the surface of the image with a relatively coarse, stiff, and rough fiber brush immediately following the cleaning means and prior to the second charging step thereby smoothing any previously toned areas and minimizing unwanted toner particle adherence.

Various means for practicing the invention and other features and advantages thereof will be apparent from the following detailed description of an illustrative preferred embodiment of the invention, reference being made to the accompanying drawings.

DESCRIPTION OF THE PREFERRED EMBODIMENTS

Although the present invention is applicable to various electrophotographic elements, methods and apparatus, the embodiment to be described is directed to a multi-color electrophotographic image producing apparatus employing an electrophotographic medium of the type disclosed in the above-identified '669 patent.

Figure 1:
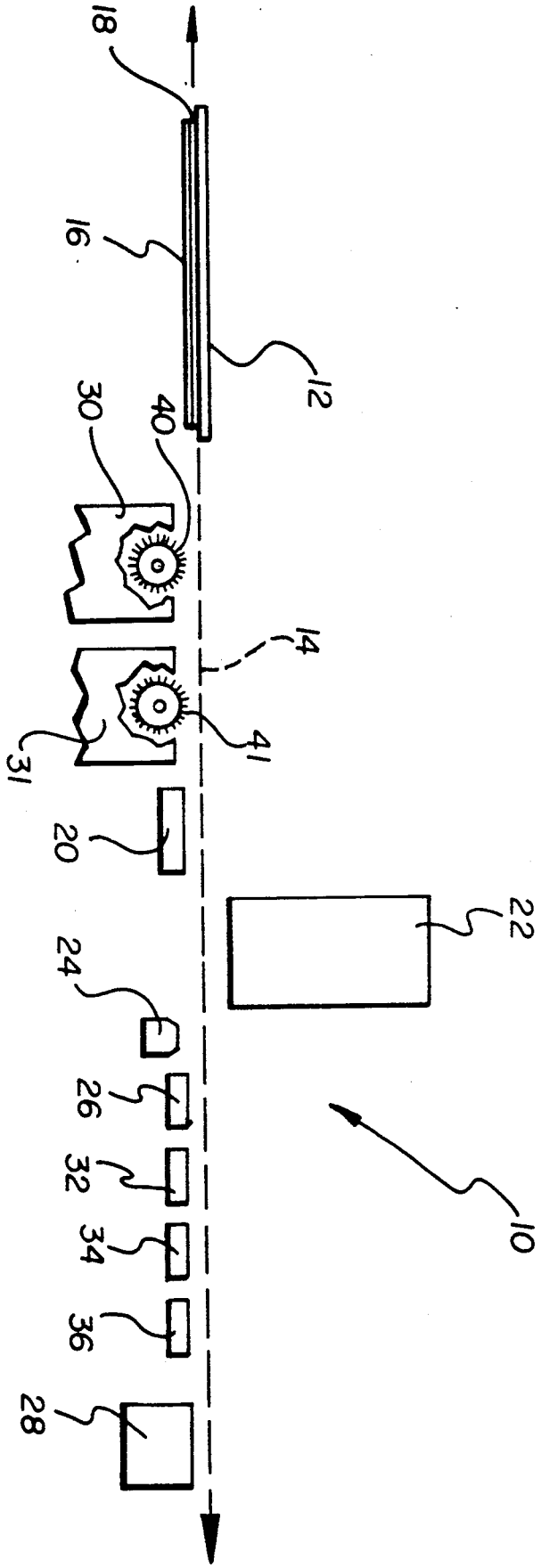
FIG. 1 is a schematic illustration of apparatus for carrying out the method of producing a multi-color electrophotographic image in accordance with the present invention.

A schematic illustration of a multi-color electrophotographic image processor is illustrated in FIG. 1 and consists of a carrier or platen 12 which is movable along the processing path, represented by dotted line 14, past the respective processing stations of the apparatus, to be described hereinafter. The path 14 may be determined by guide rails or other structure of the apparatus in a manner well-known in the art whereby the platen may move from a starting position, illustrated, to the rightmost position and then returned to the left to the starting position. The platen 12 is preferably transparent and is provided with means, not shown, for retaining an electrophotographic medium 16 on the lower surface thereof with an image-bearing transparency 18 disposed therebetween which is used to generate the image in the electrophotographic medium 16, in a manner more thoroughly described hereinbelow.

As noted in the above-cited '669 patent, the electrophotographic medium comprises a photoconductive layer on an electrically conducting substrate which is capable of transmitting actinic radiation to which the photoconductive layer is responsive. A dielectric support is releasably adhered to the substrate and comprises the photoconductive layer or an overcoat thereof which forms an outer surface of the element capable of holding an electrostatic charge. To use the element the surface of the dielectric support is charged and the photoconductive layer is image-wise exposed to the actinic radiation, thereby forming a developable electrostatic image on the dielectric surface. The electrostatic image in turn is developed with a toner to form a first color image. A composite color image can be formed on the element by repeating the sequence one or more times with image-wise exposure of the photoconductive layer to actinic radiation transmitted through the transparent support, and developing over each preceding image with a different color toner. The composite toned image is then transferred with the dielectric support to a receiving element to form a color copy which may be a color proof closely simulating the color print expected from a color print press.

Accordingly, the electrophotographic medium 16 is mounted onto the platen 12 with the transparency original 18, which may be a color separation representing a color to be printed, sandwiched therebetween. The electrophotographic medium 16 and the transparency original 18 may be held to the platen 12 by any suitable means known in the art such as a vacuum clamp whereby they are maintained in close proximity to assure satisfactory exposure, processing and register. Further, the electrophotographic medium must also be suitably grounded to the apparatus to enable the charging process to be satisfactorily carried out. A number of grounding means are known in the art and will not be described herein. As the platen 12, with the original and the electrophotographic medium 16, is translated to the right (in FIG. 1), the dielectric support of the electrophotographic medium is given an overall charge via a charging means 20, such as a corona charger, to form a uniform potential on the surface of the dielectric support. Upon being so charged the electrophotographic medium is image-wise exposed by passing beneath an exposure lamp apparatus 22 which projects light through the transparent platen 12, the transparency original 18, and through the transparent conductive substrate of the electrophotographic medium. When the photoconductive layer is thus image-wise exposed, mobile charge carriers, in this case positively charged holes, are formed in the photoconductive layer and migrate towards the interface of the photoconductive layer and the conducting layer as described in the '669 patent. Accordingly, the electric field strength in exposed regions is diminished while the field strength in unexposed regions remains approximately the same. As a result, an electrostatic differential pattern is formed on the dielectric support corresponding to the pattern on the transparency original.

The platen continues its movement, to the right in FIG. 1, passing over a pre-rinse head 24 which is fixed in position whereby the fluid head provided thereat when activated contacts the lower surface of the electrophotographic medium as it passes in the processing direction, i.e., to the right, but does not contact the medium when the fluid head is inactivated as when the platen is moved to the left in FIG. 1, to the original position. The pre-rinse head prewets the medium with a dispersant dielectric liquid prior to the liquid toning step. Thereafter, the platen moves past a raised first liquid toning station 26 which is raised into operating position whereby the lower surface of the electrophotographic medium is contacted and a toner image is imparted thereto, in a manner well-known in the art. In this system, the liquid toner is deposited in the unexposed, still charged area of the electrophotographic medium thereby forming a positive image which is a duplicate of the image carried by the transparency 18. It is also well-known in the art to produce negative images with similar electrophotographic processes wherein the charges imparted to the electrophotgraphic medium and the toners are appropriately adjusted to give a negative image. The platen continues movement to the right in the illustration, past appropriate rinse heads and dryers, not shown. The last station 28 at the right end of the apparatus is an erase lamp that exposes the electrophotographic medium after the toning operation to expose those parts of the photoconductive layer that were not exposed by the original image exposure so that the entire electrophtographic medium has substantially the same exposure history.

The platen 12 is then reversed and is returned to the starting position illustrated in FIG. 1. At this point the first original transparency or color separation 18 is removed and replaced by a second transparency or color separation and registered with the electrophotographic medium 16 preparatory for the next pass through the apparatus to generate the second color image. When the electrophotographic medium 16 and the next original sheet 18 are re-registered on the platen 12, the platen is moved to the right again for charging, exposure, and subsequent toning. However, the platen first passes over a cleaning station 30 which includes a rotating brush member 40. This cleaning station and its operation are described in the above-referenced '503 patent. When the cleaning station is raised into operative position with respect to the electrophotographic medium surface, the brush bristles engage the toned image and lightly clean it. The platen then moves to a buffing station 31 which forms the improvement of the present invention. The construction and operation of the buffing station are more thoroughly described hereinbelow.

The platen then moves to the charging station 20 where the electrophotographic medium is again charged and then moves to the exposure position 22 where light again is projected through the platen and the second color separation 18 to selectively charge the photoconductive layer in accordance with the transparancy or color separation then in contact with the electrophotographic medium. Thereafter, the platen moves the electrophotographic medium to the pre-rinse station 24 and then to a second toning station 32 which is then in operative position to tone the surface of the electrophotographic medium with a second color toner to produce a second color visible image overlying the first image. The platen subsequently moves past the aforementioned rinse and drying stations and again past the erase exposure station 28 before being returned to the starting position at the left-hand end of the apparatus. Should it be desired to create a four color image (or a three color plus black image), the charging, exposing, and toning steps will be repeated for two more color separation originals with the platen and electrophotographic medium being moved into operative contact with an additional two toning stations 34 and 36, one for each of the additional colors. Prior to each of these additonal exposing and toning steps the cleaning and buffing stations 30 and 31 are raised into brushing contact with the surface of the electrophotographic medium as the platen begins its travel to the right to again clean and buff the toned medium to both remove toning materials from the untoned portions thereof without significantly altering the toned image and then to smooth the toned image, as will be further described hereinbelow. It will be appreciated that, as known in the art, the toning order may not necessarily be represented by the physical order of the toning stations in the apparatus, and the order given above is by way of example only.

After the final toning, rinsing, and drying steps, the platen 12 is returned to the first position where the electrophotographic medium is removed. On the final return of the platen the cleaning brush 40 is again raised into the operative position to clean the final image. In keeping with the desire to rotate the cleaning brush in a direction counter to the direction of travel of the electrophotographic medium, the brush is rotated in a clockwise direction (as viewed in FIG. 1) for this operation. While there are no additional toning operations to be conducted on the medium at this point, it has been found that the final brushing step aids in the lamination of the image-bearing release layer of the film to the paper stock, minimizing artifacts that have been found to occur without this final brushing operation.

Figure 2:
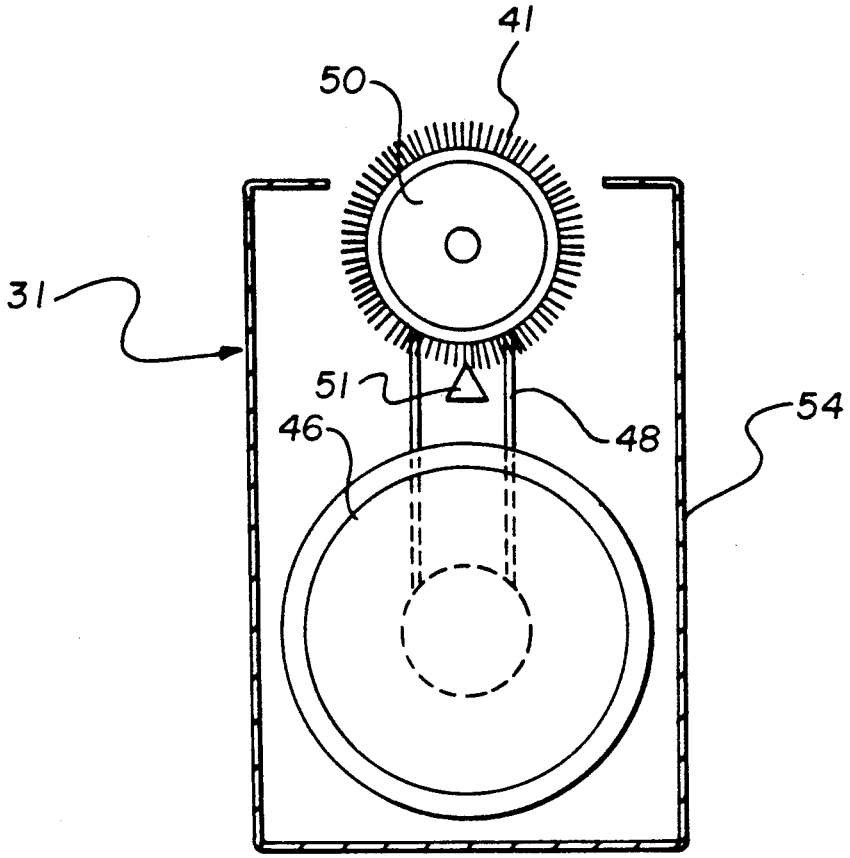
FIG. 2 is a cross-sectional view through the brushing mechanism taken along line 2–3 of FIG. 3.
Figure 3:
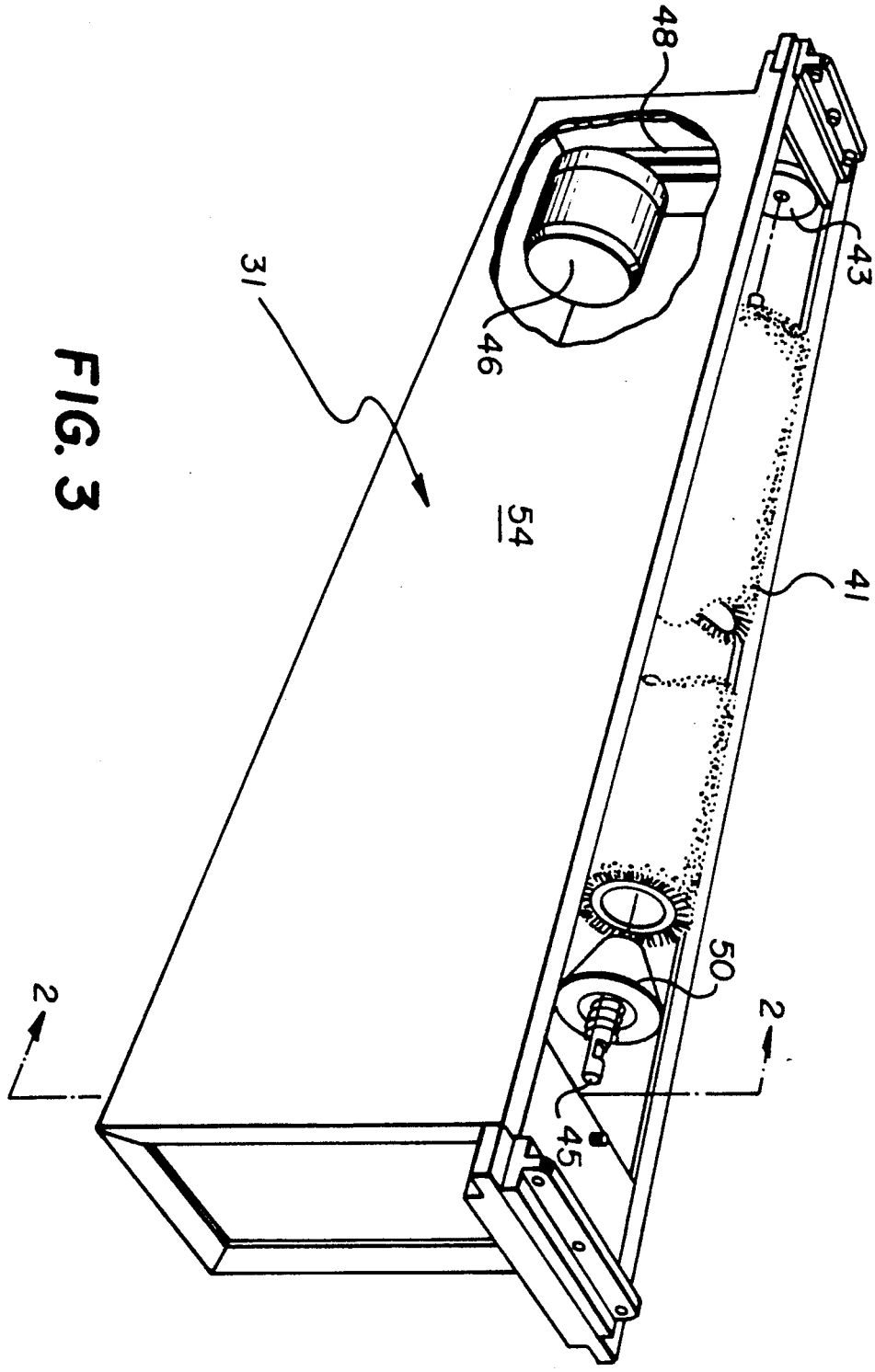
FIG. 3 is a perspective view, partially in section, of the brushing apparatus.

While the other components of the electrophotographic apparatus described herein are known in the art, the buffing station assembly 31 is described in further detail with respect to FIGS. 2 and 3. As illustrated, the buffing station assembly takes up little additional space along the travel length of the apparatus, being only wide enough to mount the brush itself and the ancillary components. In the embodiment illustrated, the buffing station assembly is a self-contained assembly carrying the necessary structural members to support the brush assembly and its drive, and can be readily dropped into the allocated position in the electrophotographic apparatus. Thus the brush 41 is journaled in the upper edge of the brush assembly at 43 and 45 for rotation about its axis, driven by a reversible motor 46 mounted below the brush and connected thereto via a belt 48. One end of the brush may be provided with a spring loaded hub 50 which facilitates the removal and replacement of the brush itself. A bar 51 is disposed below and in contact with the brush bristles to provide for cleaning of excess toner material from the bristles to extend the life of the brush material.

Although the brush is arranged for rotation in either a clockwise or counter-clockwise direction while the platen is moving from left to right, it has been found that a slight improvement in the final image is obtained when the bristles are moving in the same direction as the medium when they are in contact. Thus, the preferred direction of brush rotation is clockwise in the present embodiment. When the buffing station is in operative position the brush contacts the surface of the medium whereby the brush bristles engage the toned image and lightly buff it before the platen reaches the charging station 20.

It has been found that the brush material and texture are important factors in achieving the improvement of the present invention and should be formed of a relatively coarse, stiff and rough material. While Orlon fibers have been found to provide satisfactory brush bristles for the present invention, a preferred buffing brush is formed of bristles made of Nomex fiber which provides for optimum buffing action. (Orlon and Nomex are DuPont brand names for acrylic and aramid fibers, respectively.) In the preferred embodiment the brush has a length which is equal to or slightly greater than the width of the electrophotographic medium and the core of the brush has a diameter of approximately three inches. The length of the bristle is approximately 0.6 inches and the buffing brush station is arranged to engage the plane of the electrophotographic medium with a fiber penetration of approximately 0.065 inch so that a nip of between 0.75 and 1.0 inch is effected when the brush contacts the medium. The brush is rotated at a speed of 1700 to 1800 rpm. The weft of the brush is made of 37/2 Nomex and the pile is made of 2/20 Nomex. The pile has 50 picks/sq.in. and is further tigered to create more fibrous structure to the brush.

By buffing the developed image with a buffing brush in accordance with the present invention, it has been found that the toned image areas are prevented from becoming contaminated, such as by having their color rendition altered, as subsequent images are produced, apparently by preventing the small toner particles of the liquid developer from adhering to the portions of the previously toned areas which are not imaged in the current imaging step. Although we do not wish to be bound by any theoretical explanation of the mechanism of the present invention, a possible explanation for the results observed is that the buffing of the developed photoconductor smoothes any previously toned areas thereby minimizing unwanted toner particle adherence. It may be that such buffing locally heats the toned image areas thus fusing it and smoothing the microstructure of the toned image so that there is less surface roughness to which stray toner particles can adhere.

While the brush bristles used in the '503 patent are smooth, soft, and supple, it has been found that the most satisfactory bristles for the brush of the present invention are relatively coarse, stiff and rough. This appears to support the above theory that the brush physically smooths the surface of the toned areas. On the other hand, it must be recognized that fibers that are too stiff, such as metal fibers, can remove the entire toned image or worse.

The two brushing steps together provide for the removal of counter-ions and backround density in the untoned areas by the first brush and for the prevention of color contamination in the toned image areas by smoothing the toner surface with the second brush. Further, it has been found that the use of the same bristle material for the buffing brush as is used in the first brush does not yield the intended image quality improvement. The bristle material that solves the present problem (Nomex) does not remove the counter-ion material or backround density that is removed by the cleaning brush. Rather, its use fuses the particles which create the background density in the untoned areas producing unacceptable image quality upon subsequent toning cycles. Moreover, the material used in the cleaning brush does not solve the present problem.

ALTERNATIVE EMBODIMENT

While the buffing station has been disclosed as being preferably located between the cleaning station and the charging station, it will be appreciated that it can also be located along with the cleaning station to the right of the erase lamp 28. The only necessity is that the buffing step be accomplished after the cleaning step, if the cleaning step is used. The location of the cleaning and buffing stations between the loading position and the charging station provides the advantage that the toned electrophotographic medium has had the maximum opportunity to dry prior to cleaning and buffing without necessitating an unduly long waiting time. However, if time is not of the essence then the platen can be arranged to stop prior to the brushing assemblies to the right of the erase exposure lamp, so that the toned image is sufficiently dry to permit brushing at that location.

It will be appreciated that the present invention thus provides an improved apparatus for producing a multicolor electrophotographic image that enhances the image quality by preventing small toner particles of the liquid developers from adhering to previously toned areas, which causes altered color rendition, unless that area has been imaged during the current imaging cycle. Moreover, the present invention provides a simple and relatively easily implemented solution to this problem at a nominal cost and without any significant negative effects on the resulting image. Still further, it has been found that the present invention does not adversely affect the ability to transfer the final multi-color image to a paper substrate.

The invention has been described with reference to specific embodiments and variations, but it should be apparent that other modifications and variations can be made within the spirit and scope of the invention, which is defined by the following claims.

What is claimed is:

1. In an apparatus for producing a multi-stage electrophotographic image comprising means for providing an electrophotographic medium on a carrier therefor, means for translating the carrier and medium together over a predetermined path, means for charging the medium, means for exposing the medium to a first light-borne image, means for toning the image bearing charged region of the medium to produce a first color visible image, and means for returning the carrier to the starting position to repeat the foregoing steps of charging said medium, exposing it to a second light-borne image and toning said medium to produce a second visible image, the improvement comprising means for buffing the surface of the first toned image with a relatively course, stiff and rough fibrous brush member after said first toning step and prior to said second charging step to smooth the toned image and prevent unwanted toner particles from adhering to the first toned image.

2. The apparatus according to claim 1 including means for rotating said buffing means in a direction concurrent to the direction of movement of said medium during the buffing step.

3. The apparatus according to claim 1 wherein means is provided for supplying toning means with a liquid toner.

4. The apparatus according to claim 1 wherein means is provided for drying said image before said medium is passed into contact with said buffing brush.

5. The apparatus according to claim 1 including means for selectively moving said buffing means into and out of contact with said medium.

6. The apparatus according to claim 1 including means for removing toner components from said brush during the buffing step.

7. The apparatus according to claim 1 wherein the bristles of said brush are selected from the group consisting of acrylic and aramid fibers.

8. Apparatus for producing a multi-color electrophotographic image comprising means for providing an electrophotographic medium on a carrier therefor, translating the carrier and medium together over a predetermined path, means for charging the medium, means for exposing the medium to a first light-borne image, means for toning the image bearing charged region of the medium to produce a first color visible image, and means for returning the carrier to the starting position to repeat the foregoing steps of charging said medium, exposing it to a second light-borne image and toning said second image with a second toning element to produce a second visible image, and means for cleaning the untoned portions of the medium between the toning of the first image and the second charging step, the improvement comprising means for buffing the surface of the first toned image with a fibrous brush member after said medium has been cleaned and prior to the second charging step thereby smoothing any previously toned areas and minimizing unwanted toner particle adherence.

9. The apparatus according to claim 8 wherein means is provided for exposing and toning said medium with four different images to produce a four color image.

10. The apparatus according to claim 8 including means for actuating said buffing means after the first three toning steps.

11. The apparatus according to claim 9 including means for actuating said buffing means after each toning step.

12. The apparatus according to claim 8 including means for removing toner components from said brush during the buffing step.

13. The apparatus according to claim 8 wherein the bristles of said brush are formed of a relatively coarse, stiff, and rough fiber.

14. The apparatus according to claim 13 wherein said bristles are selected from the group consisting of acrylic and aramid fibers.

* * * * *